United States Patent [19]

Allard

[11] Patent Number: 4,949,650

[45] Date of Patent: Aug. 21, 1990

[54] TABLE HAVING A PART OF WHICH IS ADJUSTABLE UPWARDLY

[76] Inventor: David D. Allard, R.R. 1, Box 2795, Rapid City, S. Dak. 57702

[21] Appl. No.: 388,065

[22] Filed: Jul. 31, 1989

[51] Int. Cl.[5] ..... A47B 11/00

[52] U.S. Cl. ..... 108/146; 108/144; 248/918; 297/118; 297/170; 297/174

[58] Field of Search ..... 108/96, 146, 144, 93, 108/138; 312/312, 25; 248/918, 917; 297/170, 118, 174

[56] References Cited

U.S. PATENT DOCUMENTS

| | | | |
|---|---|---|---|
| 1,049,668 | 1/1913 | Carlson et al. | 108/96 |
| 3,195,482 | 7/1965 | Whitfield | 108/138 |
| 3,893,400 | 7/1975 | Grant | 108/96 X |
| 4,567,835 | 2/1986 | Reese et al. | 248/918 X |
| 4,632,349 | 12/1986 | Anstey | 108/96 X |
| 4,677,919 | 7/1987 | Baggiani | 108/144 X |
| 4,714,028 | 12/1987 | Uredat-Neuhoff | 108/149 |
| 4,751,884 | 6/1988 | Ball | 108/144 |

*Primary Examiner*—Peter A. Aschenbrenner

[57] ABSTRACT

A table adapted to be used as a coffee table having a top, all or part of which can be raised and moved laterally on struts forming a part of the legs of the table. The raised and moved portion is moved to a position where it can be used as an ordinary table for writing or the placement of food. The struts are slidable in the portion of the table used as legs and include alternate devices to support the raised part.

5 Claims, 3 Drawing Sheets

TABLE HAVING A PART OF WHICH IS ADJUSTABLE UPWARDLY

BACKGROUND AND SUMMARY OF THE INVENTION

This invention pertains to tables and more particularly to a table having a top, part or all of which is adjustable as to height.

For many years, coffee tables have been used as repositories for books, magazines, and the like in a great many homes. They may also be used, on occasion, as a place on which to place snacks, hors d'oeuvres, and beverages. In most instances when food or drink are placed on the table, it is necessary to bend over to reach the dish. It is also clumsy to eat from a plate when the plate is at a level so much lower than that to which one is accustomed.

By my invention, I provide a table which may appear to be an ordinary coffee table in front of a sofa. However, when desired, one portion of the top surface of the table or the entire surface may be raised to regular table height, or something less if appropriate, so that a meal can be served on that raised portion of the table to anyone seated on an adjacent sofa. Upon completion of the meal, the raised portion of the table can again be depressed to form a continuous top with the other portion of the table top, or the entire top can be returned to coffee table height.

DESCRIPTION

Figure 1:
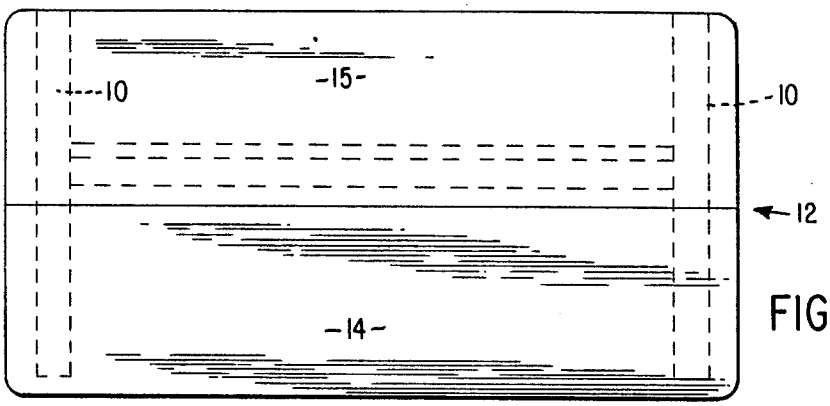
FIG. 1 is a top plan view of the table in its normal position.

Briefly, my invention comprises a magazine table having the top or a portion of that top which can be elevated to be used as a support for eating utensils.

More specifically, and referring to the drawings, the table is supported from a base including a floor engagement part 10. This part may take various forms, but must be broad enough to provide stable support for the table. Vertical support for the table top is provided by a leg means which must include a diagonal portion. In the first embodiment shown in FIGS. 1–5, this is shown as a diagonal leg 11 extending from the base 10 to the normal level of the top 12 as shown in FIGS. 1–3.

Brackets 13 or the like may be used to support the stationary section 14 of the top.

Figure 2:
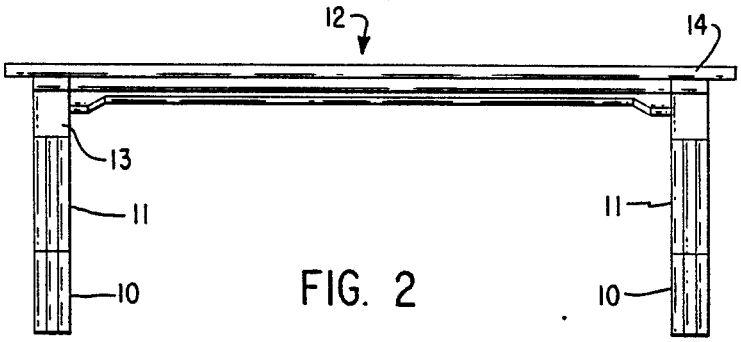
FIG. 2 is a front elevational view of the table as shown in FIG. 1.
Figure 3:
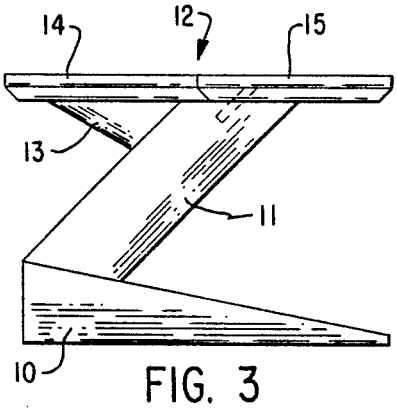
FIG. 3 an end elevational view of the table in its normal position.

A movable portion 15 of the top is adapted to fit close to the stationary part 14 when the table is in its normal position (FIGS. 1–3). In this position, the table appears to be an ordinary coffee or magazine table except for the division between the two parts of the top. However, this part 15 is separately supported on a post 17 slidably engaged with the leg 11.

Figure 4:
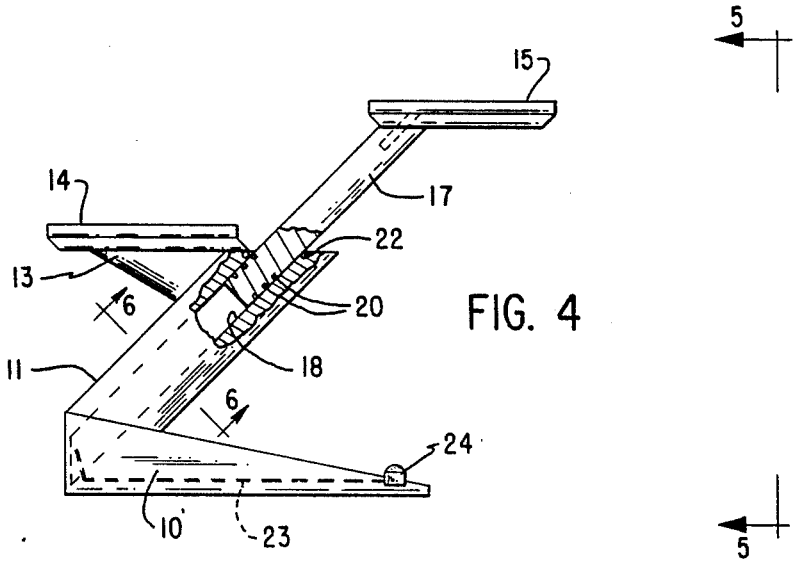
FIG. 4 is an end elevational view of the table in its raised position with part of the legs broken away to show interior parts.
Figure 5:
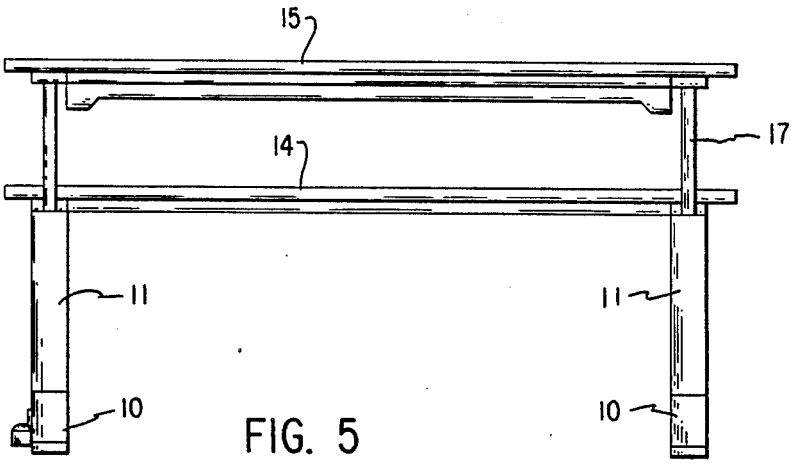
FIG. 5 is a view from line 5—5 of FIG. 4.
Figure 6:
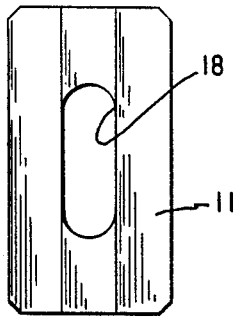
FIG. 6 is a detailed view of the end of the fixed part of the leg from line 6—6 of FIG. 4.
Figure 7:
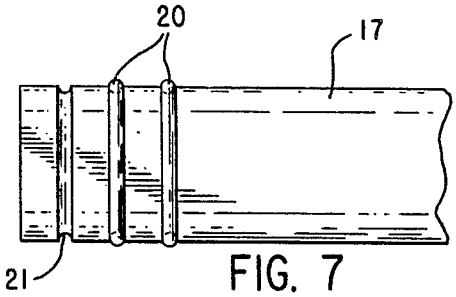
FIG. 7 is a side view of a part of the moveable part of the leg.
Figure 8:
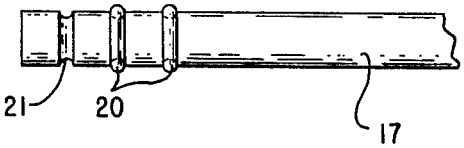
FIG. 8 is a view of the edge of the part shown in FIG. 8.

In the embodiment shown in the first eight figures, the post 17 is slidably disposed in a socket 18 in the leg 11. In this embodiment, the socket is formed to be substantially air tight. The post 17 carries a series of flexible rings 20 similar to 0-rings disposed in grooves 21 (FIGS. 7 & 8) in the post. These rings serve to provide a secure seal between the walls of the socket 18 and the post. Seal rings 22 may be provided at the top of the socket 18 (FIG. 4).

In order to allow air to get into and out of the socket 18, I provide a duct 23 leading from the socket 18 to a valve 24 which may be foot operated. This is a very simple valve, normally closed, but arranged so that foot pressure on its operating member will open the valve to allow passage of air between the socket and the atmosphere.

To operate the table from its normal to its raised position, a person should grasp the moveable part 15 of the top, then press the operating member of the valve 24 so that air can bleed into the cylinder 18 through the duct 23. When the part 15 reaches the desired height, the valve is allowed to close, trapping the air in the cylinder and thus holding the piston in that position. If the part 15 is then to be lowered, the valve 14 is again opened to allow the air in the cylinder 18 to escape and the part 15 can then be pushed downwardly back into place.

Although the foregoing description is of a table with only a portion of the top being raised; it will be obvious that varying proportions of the top even up to and including the entire top could be made moveable if desired.

Figure 9:
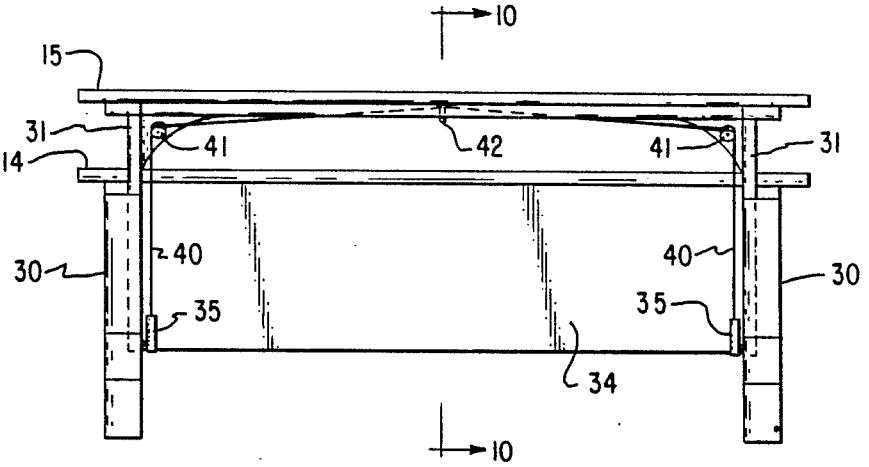
FIG. 9 is a view similar to FIG. 5 of a table with an alternative stop mechanism.
Figure 10:
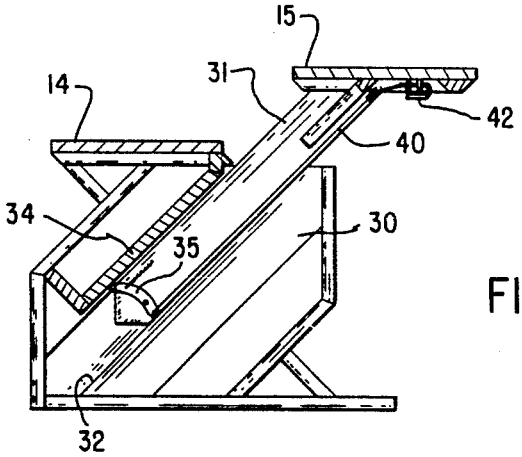
FIG. 10 is a view from line 10—10 of FIG. 9.
Figure 11:
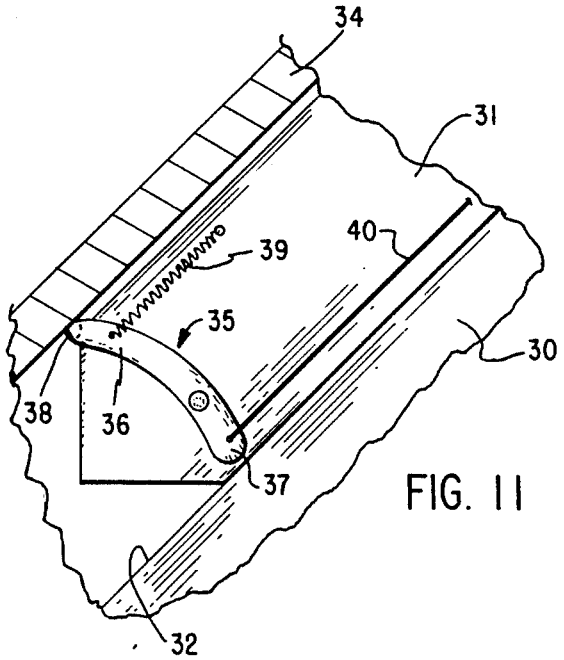
FIG. 11 is a detailed view of the operative part of the stop mechanism of the alternative table.

The alternate embodiment shown in FIGS. 9–11 operates much the same way. This alternate is less expensive to build, but may be somewhat less aesthetically pleasing in that the operating mechanism may be exposed. This embodiment illustrates, however, that the exact structure of the supporting legs is not material. As best shown in FIG. 10, the sloping mechanism can be just as well enclosed in a full flat side 30 as in a leg 11.

The moving part 15 of the table top is mounted on a slide member 31 somewhat similar to the post 17. However, here the member 31 is slidably disposed in a groove 32 formed in the side 30. Although not shown, a tongue and groove guide may be used to keep the member 31 within the groove 32.

In this embodiment the means for holding the part 15 of the table in its adjusted or upward position is mechanical rather than pneumatic. This means comprises a lever 35 pivotally mounted on the member 31. As shown, the lever is preferably mounted so that one end 36 is somewhat larger than the other end 37.

The longer end 36 is adapted to engage the lower part of a broad surface 34 which may be a board extending between the legs of the table. This engagement may be such that the tip end 38 digs into the wood on the board 34, or the tip may carry some sort of friction pad such as a knurled or corregated surface or a rubber or similar surface. The desideratum is that there be sufficient friction between the lever 35 and the surface of the board 34 so that the member 31 will be held against movement in a downward direction.

A spring 39 may be used to bias the lever 35 to the engaged position shown in FIG. 11. The illustration is of a tension spring, and that may be preferred. However, it will be obvious that a compression spring in an opposite location will also function as a biassing means. It will also be apparent that other means—even including a properly located weight may be used to accomplish the purpose of holding the tip 38 of the lever against the inner surface of the board 34.

Release of the engagement of the lever is accomplished by cable means in this embodiment. A cable 40 or similar cord is attached to the lever 35 at the end 37 opposite the tip 38. This cable runs along the inside surface of each member 31 to a pulley 41 and then to a hook-shaped pull 42. A pulley, although not absolutely necessary, may also be used near this point to provide a change in direction of the cable just before the pull 42. The second pulley does provide a somewhat cleaner installation.

The operation of this embodiment is much the same as that first described. The moveable part 15 can be pulled up at any time. The lever will simply slide along the inner surface of the board 34. When the desired level is reached, a little movement downward will cause the tip 38 to jam into the surface of the board and thus will prevent downward movement of that part of the table. Then when it is desired to lower the part 15, the operator pulls the hook 42, thus pulling the lever to move the tip 38 out of engagement with the surface of the board 34. It may be somewhat easier to pull the levers, if the part 15 is first raised very slightly to help release each lever tip 38 from its engagement with the board 34 so that the force required to move the lever is relatively small. By releasing the tip 38, the part 15 of the table top is free to be dropped partially or all the way to again match the other surface 14.

Again, the portion of the top that is moveable is not critical. If desired the entire top surface could be made moveable.

I claim as my invention:

1. A table comprising a top and leg means at each end of said top adapted to support said top, said leg means being a stationary part and at least a portion of said top being a moveable part, post members fastened to each end of said moveable part, said post members being slidably engaged in grooves formed in said leg means, means on said leg means adapted to provide a surface adjacent said grooves, means engaged between said post members and said leg means to allow upward movement and prevent downward movement of said post members relative to said leg means, said means engaged between said post members and said leg means including at least one lever on said post member, one end of each said lever being releasably engageable with the surface on said means on said leg means, and release means engaged with each of said levers adapted operate said lever to release the engagement.

2. The table of claim 1 in which said means on said leg means adjacent said grooves is a board engaged between said leg means.

3. The table of claim 1 in which said release means include cable means attached to said lever and extending to the under surface of said moveable part.

4. A table comprising a top and leg means at each end of said top adapted to support said top, said leg means being a stationary part and at least a portion of said top being a moveable part, post members fastened to each end of said moveable part, said post members including a portion thereof formed as a piston, said leg means including a portion formed as a cylinder, said piston being slidably disposed in said cylinder, said slidable relationship thus comprising a pneumatic piston and cylinder assembly allowing upward movement and controlled downward movement of said moveable part relative to said stationary part, and release means including a valve connected to said cylinder which normally seals the interior of said cylinder from the atmosphere but is openable to allow air to flow between the interior and the atmosphere.

5. A table comprising a top and leg means at each end of said top adapted to support said top, said leg means being a stationary part, said top being divided into a fixed top and moveable top, said fixed top being fixed to said leg means, thus forming a portion of said stationary part, post members fastened to each end of said moveable top, said post members being slideably engaged with said leg means and holding means engaged between said post members and said leg means to allow upward movement and prevent downward movement of said post members relative to said leg means, said means engaged between said post members and said leg means including release means adapted to release said holding means.

* * * * *